US009189922B2

(12) United States Patent
Azuma et al.

(10) Patent No.: US 9,189,922 B2
(45) Date of Patent: Nov. 17, 2015

(54) GAME MACHINE AND CONTROL METHOD THEREOF

(71) Applicants: Shogo Azuma, Minato-ku (JP); Mitsuru Kodama, Minato-ku (JP); Shinya Ito, Minato-ku (JP); Norifumi Kawai, Minato-ku (JP)

(72) Inventors: Shogo Azuma, Minato-ku (JP); Mitsuru Kodama, Minato-ku (JP); Shinya Ito, Minato-ku (JP); Norifumi Kawai, Minato-ku (JP)

(73) Assignee: KONAMI DIGITAL ENTERTAINMENT CO., LTD., Minato-Ku, Tokyo (JP)

( * ) Notice: Subject to any disclaimer, the term of this patent is extended or adjusted under 35 U.S.C. 154(b) by 87 days.

(21) Appl. No.: 13/862,868

(22) Filed: Apr. 15, 2013

(65) Prior Publication Data

US 2013/0281199 A1 Oct. 24, 2013

(30) Foreign Application Priority Data

Apr. 19, 2012 (JP) ..... 2012-096055

(51) Int. Cl.
*G07F 17/32* (2006.01)

(52) U.S. Cl.
CPC ..... *G07F 17/3258* (2013.01)

(58) Field of Classification Search
None
See application file for complete search history.

(56) References Cited

U.S. PATENT DOCUMENTS

| | | | | |
|---|---|---|---|---|
| 2009/0111561 | A1* | 4/2009 | Dewaal et al. | 463/20 |
| 2012/0088577 | A1* | 4/2012 | Decasa et al. | 463/27 |
| 2012/0094744 | A1* | 4/2012 | Parrinello et al. | 463/25 |
| 2013/0252720 | A1* | 9/2013 | Milligan et al. | 463/27 |

FOREIGN PATENT DOCUMENTS

JP 2010-131285 A 6/2010

OTHER PUBLICATIONS

Japanese Office Action with English Translation—Issued Mar. 4, 2014.

Patent Examination Report No. 1; AU 2013205294; Date of Issue: Sep. 25, 2014.

* cited by examiner

*Primary Examiner* — Jason Yen

(74) *Attorney, Agent, or Firm* — Howard & Howard Attorneys PLLC

(57) ABSTRACT

In the game machine which adopts an accumulation-type progressive jackpot with a jackpot payout increasing according to a game play of a player and increases the jackpot payout by a predetermined unit according to a predetermined number of game plays by the player, the game machine includes a monitor which displays a game screen. The game machine counts the jackpot payout increasing according to the game play of the player by each player as a separate increment, manages a fraction with the separate increment smaller than the predetermined unit in association with the player and controls the display device so as to display the fraction.

16 Claims, 15 Drawing Sheets

GAME MACHINE AND CONTROL METHOD THEREOF

CROSS REFERENCE TO RELATED APPLICATION

This application claims priority to Japanese Patent Application No. 2012-096055, filed Apr. 19, 2012, the disclosure of which is hereby incorporated by reference in its entirety.

TECHNICAL FIELD

The present invention relates to a game machine and the like which provide a progressive jackpot game.

BACKGROUND ART

For example, there is a medal game machine that provides a jackpot expected to provide high payout in addition to a payment based on prize winning in a normal game (for example, see Patent Literature 1). When satisfying a predetermined game condition or winning the jackpot game, payout reserved as the jackpot is paid to a player. In determining payout amount of the jackpot, an accumulation-type progressive jackpot system is adopted that makes a reserve according to a medal consumed by a player playing in the game machine in addition to a minimum amount of the jackpot. For example, when the player consumes 100 pieces of medals in the game machine, the payout of the jackpot is set to increase by one piece.

Patent Literature 1: JP-A-2010-131285.

SUMMARY OF INVENTION

Technical Problem

Even when the progressive jackpot system is adopted and the payout amount of the jackpot continues to increase, the player is playing a game without knowing the association between the jackpot increase and the player's own play. In the case of the jackpot display in which the payout amount of the jackpot always increases, it is difficult to discern whether the increase is caused by the player's own play or by other players. There is no game machine that motivates the player to continue the game by making the player know that the jackpot increases based on the player's play.

Therefore, the present invention aims to provide a game machine and the like, which present a progressive jackpot increase in association with a player's play.

Solution to Problem

The game machine of the present invention is a game machine which adopts an accumulation-type progressive jackpot with a jackpot payout increasing according to a game play of a player and increases the jackpot payout by a predetermined unit according to a predetermined number of game plays by the player, wherein the game machine comprising: a display device which displays a game screen; a fraction managing device which counts the jackpot payout increasing according to the game play of the player by each player as a separate increment and manages a fraction with the separate increment smaller than the predetermined unit in association with the player; and a fraction display control device which controls the display device so as to display the fraction.

The game control method of the present invention is a game control method executed in a game machine which adopts an accumulation-type progressive jackpot with a jackpot payout increasing according to a game play of a player and increases the jackpot payout by a predetermined unit according to a predetermined number of game plays by the player, wherein the game control method comprising: a fraction managing step which counts the jackpot payout increasing according to the game play of the player by each player as a separate increment and manages a fraction with the separate increment smaller than the predetermined unit in association with the player; and a fraction display control step which controls a display device which displays a game screen so as to display the fraction.

According to the present invention, the jackpot payout increases according to the game play of the player. The increasing payout is counted as the separate increment of each player and the fraction smaller than the predetermined unit of the jackpot is managed. Since the fraction of the player is displayed on the display device, the player can easily know the degree of the player's own fraction. Accordingly, the fraction tending to be overlooked is presented to the player, and the fraction increases according to the play, thus providing the player with the pleasure of collecting the fraction. When the fraction increases to the predetermined unit the jackpot payout increases. Therefore, the player can easily understand the association between the player's play and the jackpot accumulation.

As one aspect of the game machine of the present invention, the fraction display control device makes the display device display a portion of a target object for counting the jackpot payout according to the ratio of the fraction. According to this, According to this, since the ratio of the fraction is represented by the display of a portion of the target object, the fraction can be easily known. In this aspect, the target object is a medal.

As one aspect of the game machine of the present invention, further comprising, a payout adding device which adds a predetermined unit to the jackpot payout in case that the separate increment satisfies the predetermined unit in the fraction managing device. According to this, when the fraction of the separate increment accumulated according to the player's play is increased to a predetermined unit, the fraction is accumulated in the jackpot payout. Since the fraction of the player is added to the jackpot payout as the predetermined unit, the player can easily know the association between the player's own play and the jackpot payout increase.

As one aspect of the game machine of the present invention, further comprising, a payout adding device which adds a predetermined multiple of a predetermined unit to the jackpot payout in case that the separate increment satisfies the predetermined unit in the fraction managing device. According to this, in case that the fraction of the separate increment accumulated according to the player's play increases to a predetermined unit, a predetermined multiple of the predetermined unit is added to the jackpot payout. When the player accumulates and collects the fraction to the predetermined unit, a predetermined multiple of the predetermined unit is added to the jackpot payout, and therefore, the collection of the fraction is motivated.

In the aspect that the payout adding device is provided, comprising, an addition amount storage device which stores the amount added by the player in association with the adding player in case that the jackpot payout is added by the payout adding device. According to this, the amount added to the jackpot by the player is stored in association with the player. In this aspect, comprising, a payment executing device which executes the payment of the jackpot; wherein the payment executing device pays a portion of the payout to other players according to the amount added to the payout by the other players in case that the payout is paid to the player wining the jackpot. According to this, in the case of jackpot winning, a player not to play the jackpot game can receive payout according to the contribution to the accumulation of the jackpot. Accordingly, the player is motivated to play a game to accumulate the separate increment.

As one aspect of the game machine of the present invention, further comprising, a collection item giving device which gives at least one item among a plurality of types of collectable items in case that the separate increment satisfies the predetermined unit. According to this, when the fraction is collected to a predetermined unit, the item is given to the player. The player is motivated to collect the fraction. In this aspect, the payout adding device adds a predetermined amount to the jackpot payout in case that a predetermined type of item is collected among the plurality of types of items. According to this, the addition of the payout to the jackpot is increased by the collection of the item. Accordingly, the collection of the item is motivated.

Advantageous Effects of Invention

As described above, according to the present invention, the jackpot payout increases according to the game play of the player. The increasing payout is counted as the separate increment of each player and the fraction smaller than the predetermined unit of the jackpot is managed. Since the fraction of the player is displayed on the display device, the player can easily know the degree of the player's own fraction. Accordingly, the fraction tending to be overlooked is presented to the player, and the fraction increases according to the play, thus providing the player with the pleasure of collecting the fraction. When the fraction increases to the predetermined unit the jackpot payout increases. Therefore, the player can easily understand the association between the player's play and the jackpot accumulation.

DESCRIPTION OF EMBODIMENTS

Figure 1:
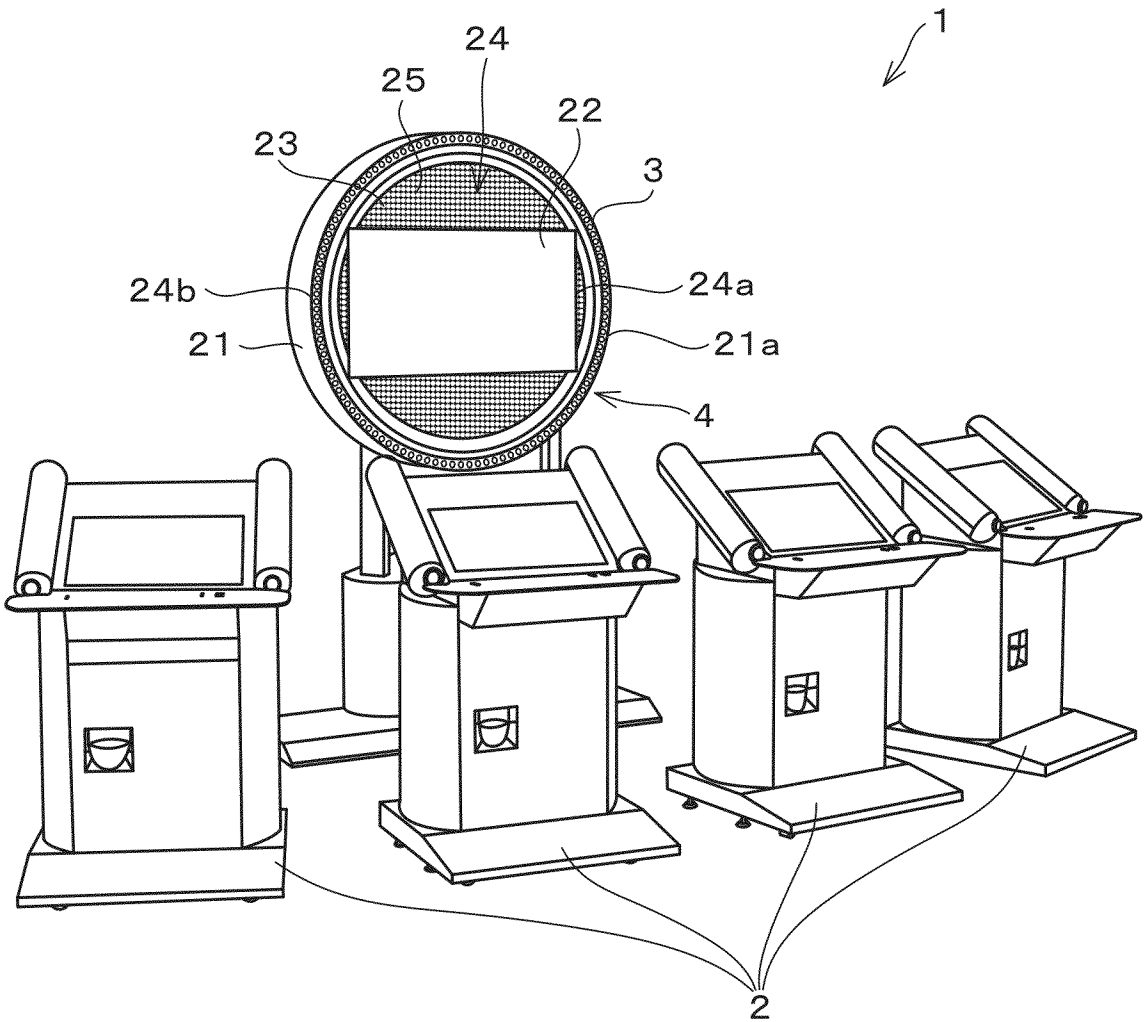
FIG. 1 is an overall view of a game machine according to one aspect of the present invention.
Figure 2:
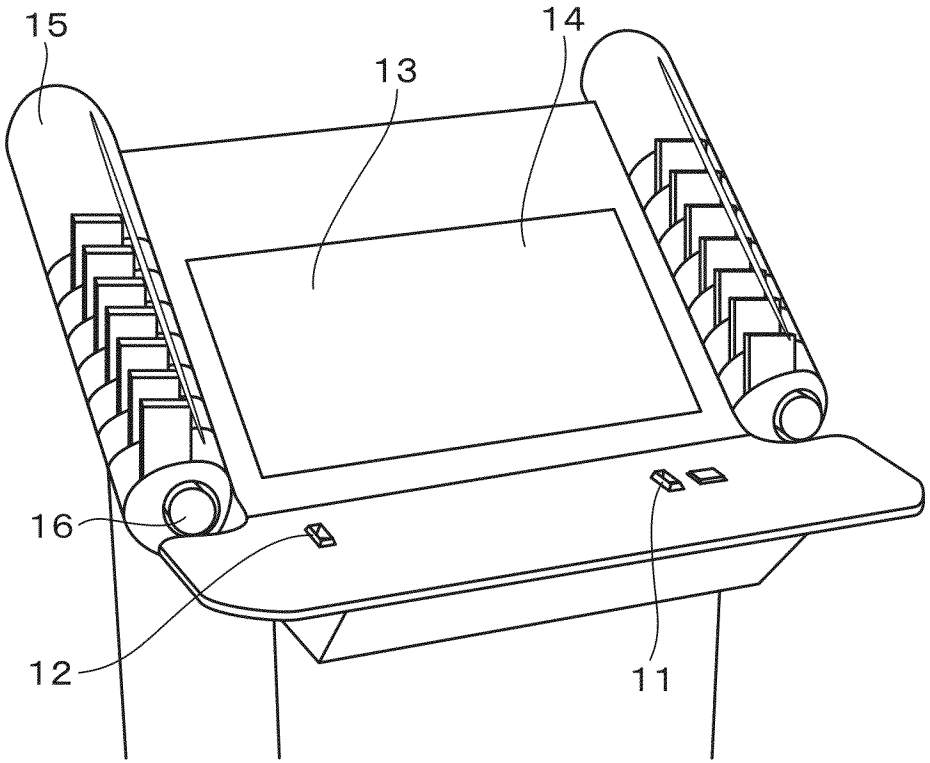
FIG. 2 is an enlarged view of a main portion of a station unit.

FIG. 1 is an overall view of a game machine according to one aspect of the present invention. The game machine 1 includes a plurality of station units 2 and a center unit 3. The game machine 1 is a medal game machine using a medal M as a game medium, and allows a predetermined range of game play in exchange for medals M input by a player. The player plays the game by each station unit 2. FIG. 2 is an enlarged view of the station unit 2. Each station unit 2 includes a medal insertion slot 11, a coin insertion slot 12, a monitor 13 displaying a game screen, a transparent touch panel 14 superimposed on the surface of the monitor 13, a pair of bonus step display units 15 which displays an indication of the start of a bonus game and a pair of chance game buttons 16 which starts a chance game.

In each station unit 2, a dual play is available, and the bonus step display unit 15 and the chance game button 16 arranged on each of the left and right sides are allocated to each player. The bonus step display unit 15 is provided with a plurality of lights, and the lights are turned on/off according to game progress. When all of the lights are turned on, the bonus game is executed. When a predetermined game condition is satisfied, the chance game button 16 can be pressed. When the chance game button 16 is pressed, the chance game is executed. The medal insertion slot 11 and the coin insertion slot 12 are provided in common to the respective players. For example, when a 100-yen coin is inserted into the coin insertion slot 12, medals M exchangeable for 100 yen is retained and the medal M is consumed according to the play. As an example, a liquid crystal display is applied to the monitor 13, and the game is progressed when the touch panel 14 superimposed on the monitor 13 is operated by the player.

The center unit 3 is provided with a common display device 4. The common display device 4 is provided with a housing 21 and an LED display 24 including a liquid crystal display 22 as a first display device supported by the housing 21 and a plurality of LED elements 23 as a plurality of second display devices. A variety of well-known rectangular liquid crystal display devices are applied to the liquid crystal display 22. The LED display 24 is provided with a light diffusing panel 25 covering the LED elements 23. The light diffusing panel 25 includes a resin plate having a surface asperity, and diffuses light emitted by the LED elements 23. A well-known light diffusing plate may be used in the light diffusing panel 25. In addition, a plurality of decorative lights 21*a* is arranged around the LED display 24 to surround the LED display 24. In addition, a decoration and an illumination may be provided around the liquid crystal display 22 and the LED display 24. The liquid crystal display 22 and the LED display 24 may be collectively referred to as an entire display. A rotary driving mechanism (not illustrated) is provided in the common display device 4. The rotary driving mechanism drives the entire display to rotate.

Figure 3:
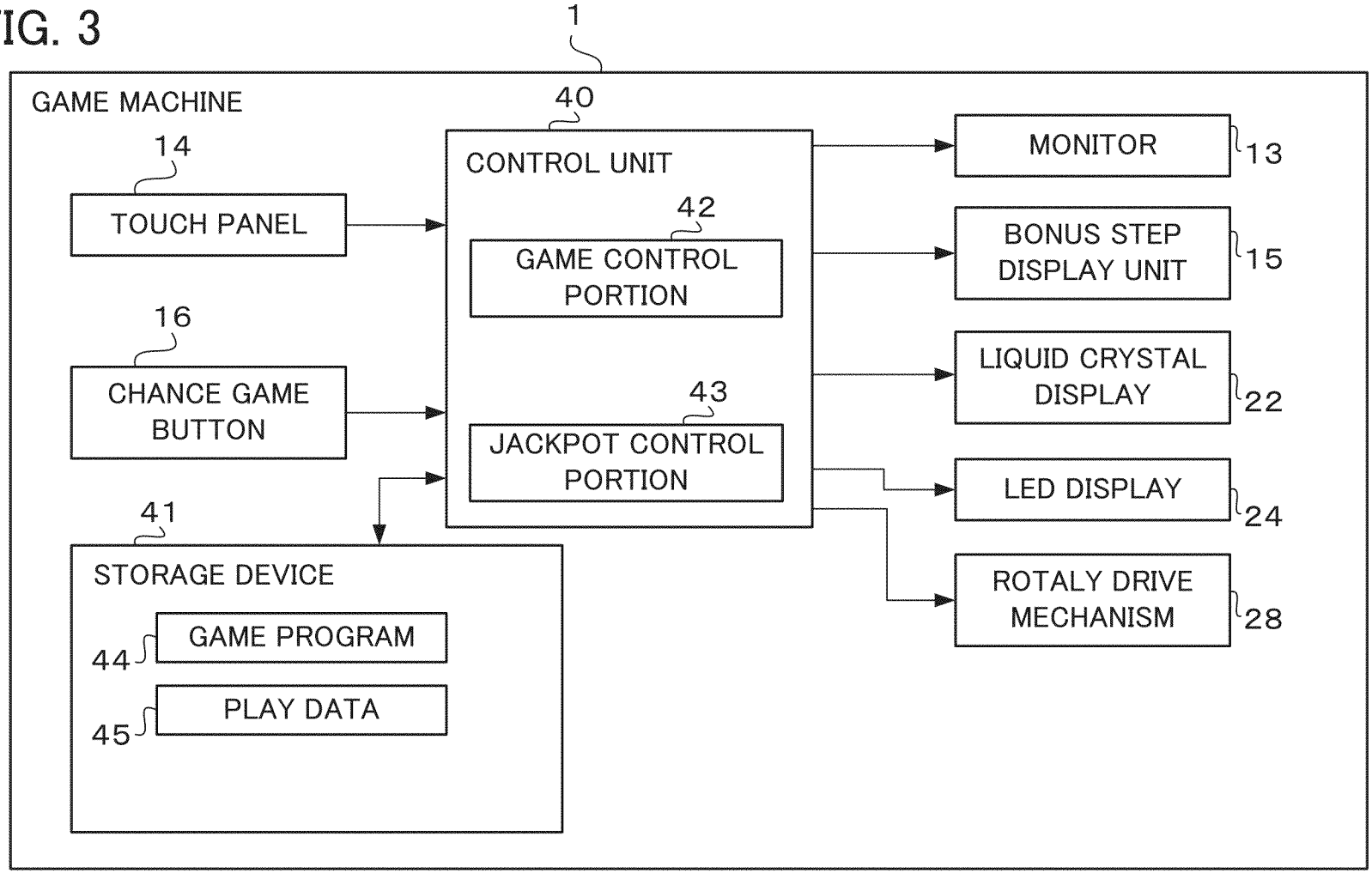
FIG. 3 is a functional block diagram illustrating a configuration of a main portion of a control system of the game machine.

FIG. 3 is a functional block diagram illustrating a configuration of a control system of the game machine 1. The game machine 1 includes a control unit 40 and a storage device 41. The control unit 40 is a computer unit that includes a microprocessor, a ROM recording a program such as an operating system to be executed in the microprocessor and an internal storage device (not illustrated) such as a RAM providing a work area for the microprocessor. Input devices such as the touch panel 14 and the chance game button 16, and output devices such as the monitor 13, the bonus step display unit 15, the liquid crystal display 22, the LED display 24, and the rotary drive mechanism 28 are connected to the control unit 20.

A game control portion 42 and a jackpot control portion 43 are provided in the control unit 40. The game control portion 42 and the jackpot control portion 43 are logical devices which are achieved by a combination of predetermined software and computer hardware of the control unit 40. The game control portion 42 executes a variety of processing that is related to the management of the start, progress and end of the game in the game machine 1, and the play of the arcade game such as the collection of a play fee. The jackpot control portion 43 executes the processing related to progressive jackpots accumulated according to the player's play. In addition, although not illustrated, the control unit 40 of the game machine 1 executes a variety of processing such as display control processing of the monitor 13 or the common display device 4, and management processing of a medal or a coin collected from the player.

The storage device 41 stores a game program 44 and play data 45. The game program 44 is executed by the control unit 40 to provide a game playable in the game machine 1. The play data 45 includes data of the game played by each player. The game machine 1 may be configured so as to authenticate the player by a card storing a player ID, and a portion of the play data associated with the player ID may be obtained from a server. As will be described below in detail, the jackpot control portion 43 counts a separate increment for each player among the progressive jackpots increasing according to the player's play. Among the separate increment, a fraction smaller than one piece is stored in the play data 45 in associated with the player. Furthermore, the number of one or more pieces of medals added to the progressive jackpot by the player is stored in the play data 45 in association with the player.

Figure 4:
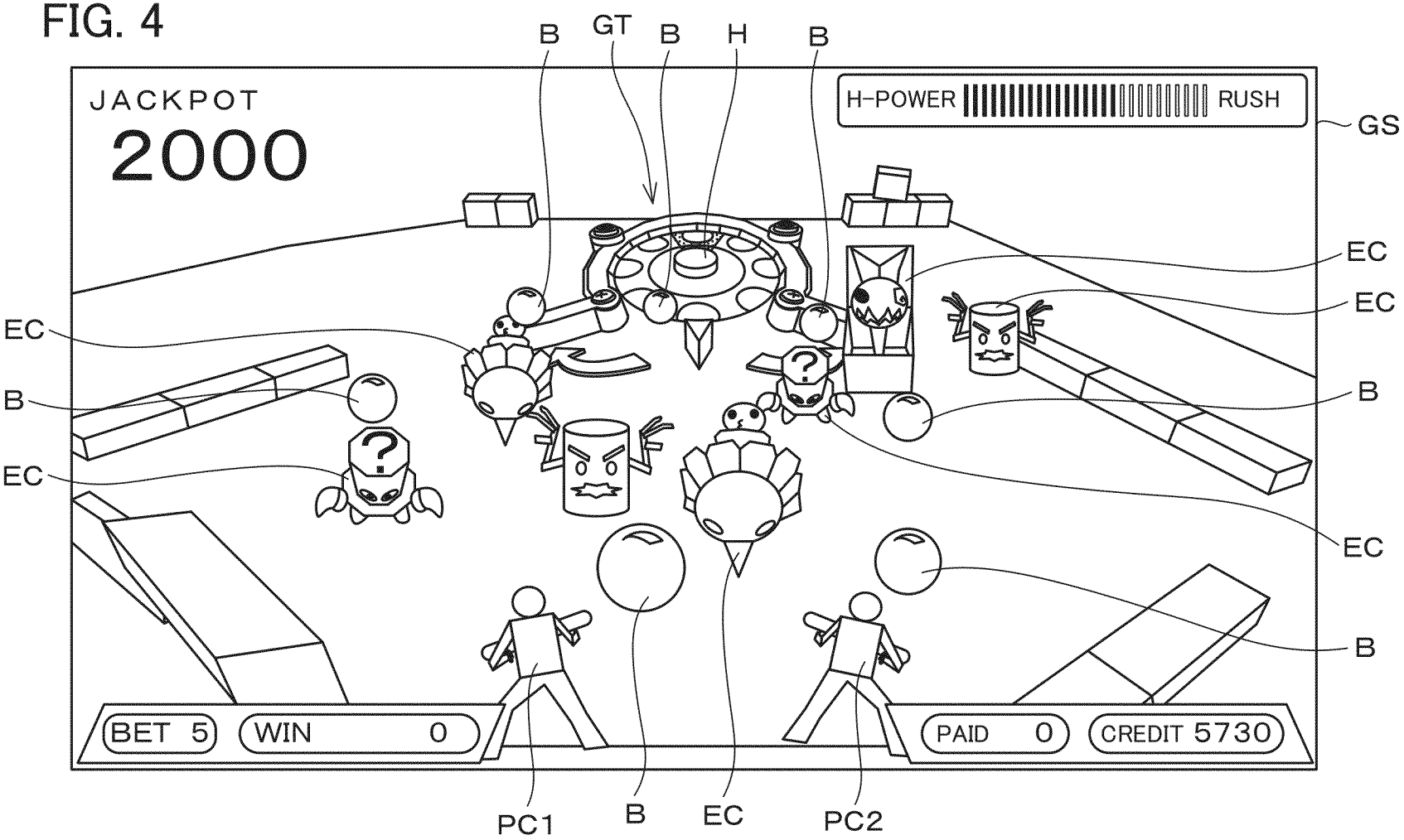
FIG. 4 is a diagram illustrating an example of a game screen displayed on a monitor of each station unit.

The game executed in the game 1 will be described with reference to FIG. 4. FIG. 4 is a view illustrating an example of a game screen GS displayed on the monitor 13 of each station unit 2. On the game screen GS, player characters PC1 and PC2 operated by the respective players (which will be represented by a referential mark "PC" if discrimination therebetween is not necessary), an enemy character EC and a ball B thrown by the player character PC are displayed. The player can made the player character PC throw the ball B according to the number of medals inserted into the game machine 1. When the ball B hits the enemy character ES, the enemy character EC is defeated. When the enemy character EC is defeated, a gate GT located inside at the center of the game screen GS is opened. When the ball B enters a hit hole H in the gate GT, one of the lights provided in the bonus step display unit 15 is turned on. When all of the lights of the bonus step display unit 15 are turned on, the bonus game is started on the monitor 13.

Figure 5:
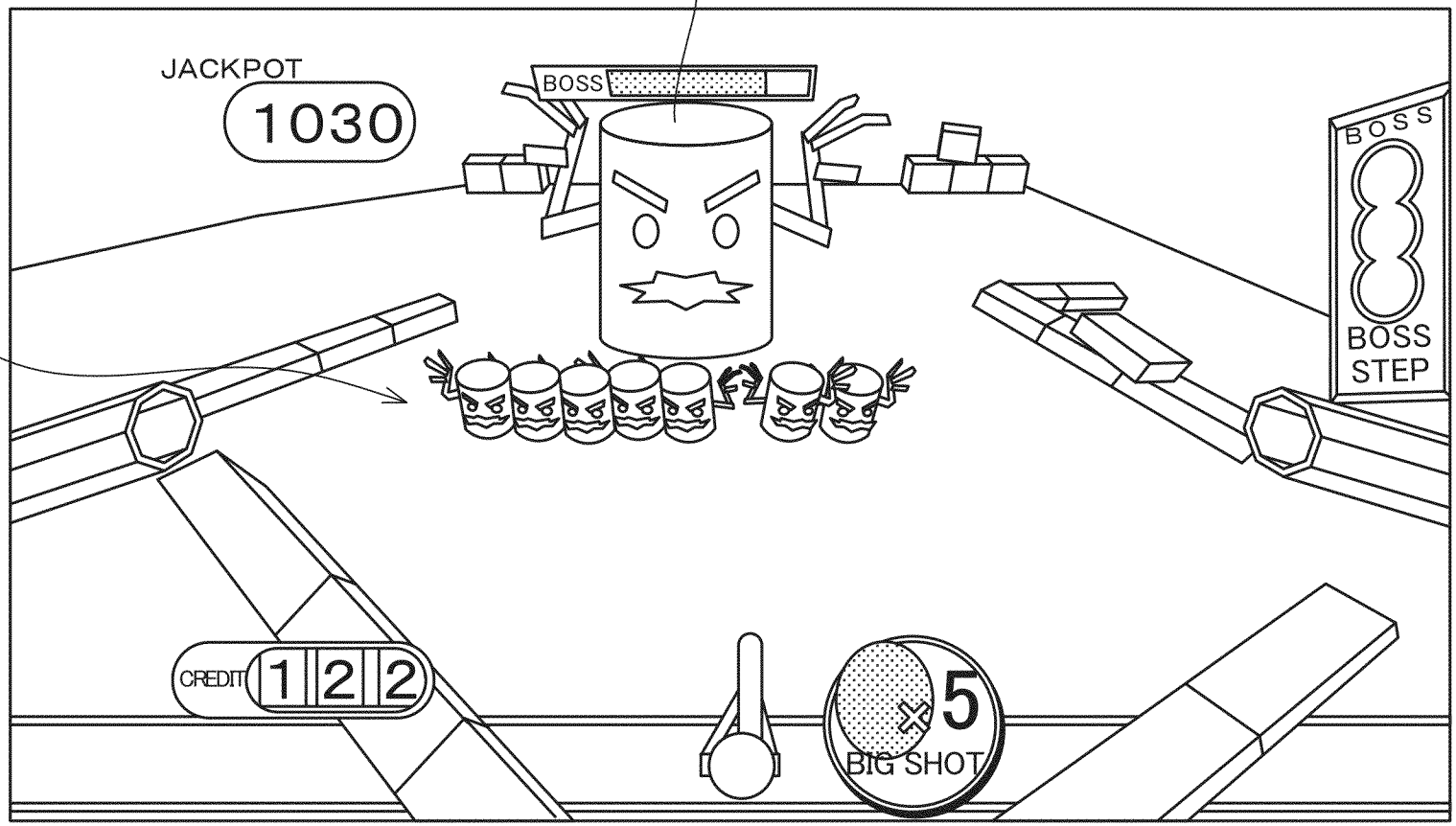
FIG. 5 is a diagram illustrating an example of a bonus game in the game screen.

FIG. 5 is a view illustrating another example of the game screen GS. In the game screen GS of FIG. 5, an example of the bonus game is illustrated. In the bonus game, the player is given a predetermined number of large balls (for example, five balls), and throws the large balls at a boss character ECB to defeat the boss character ECB. When the boss character ECB is defeated, the player is allowed to press the chance game button 16. When the chance game button 16 is pressed by the player, the chance game is started. The chance game is displayed on the common display device 4. In the chance game, a plurality of lottery machines is prepared, and lotteries with different lottery probabilities are performed in the respective lottery machines. When winning a lottery performed by three lottery machines, the player can obtain a jackpot.

Figure 6:
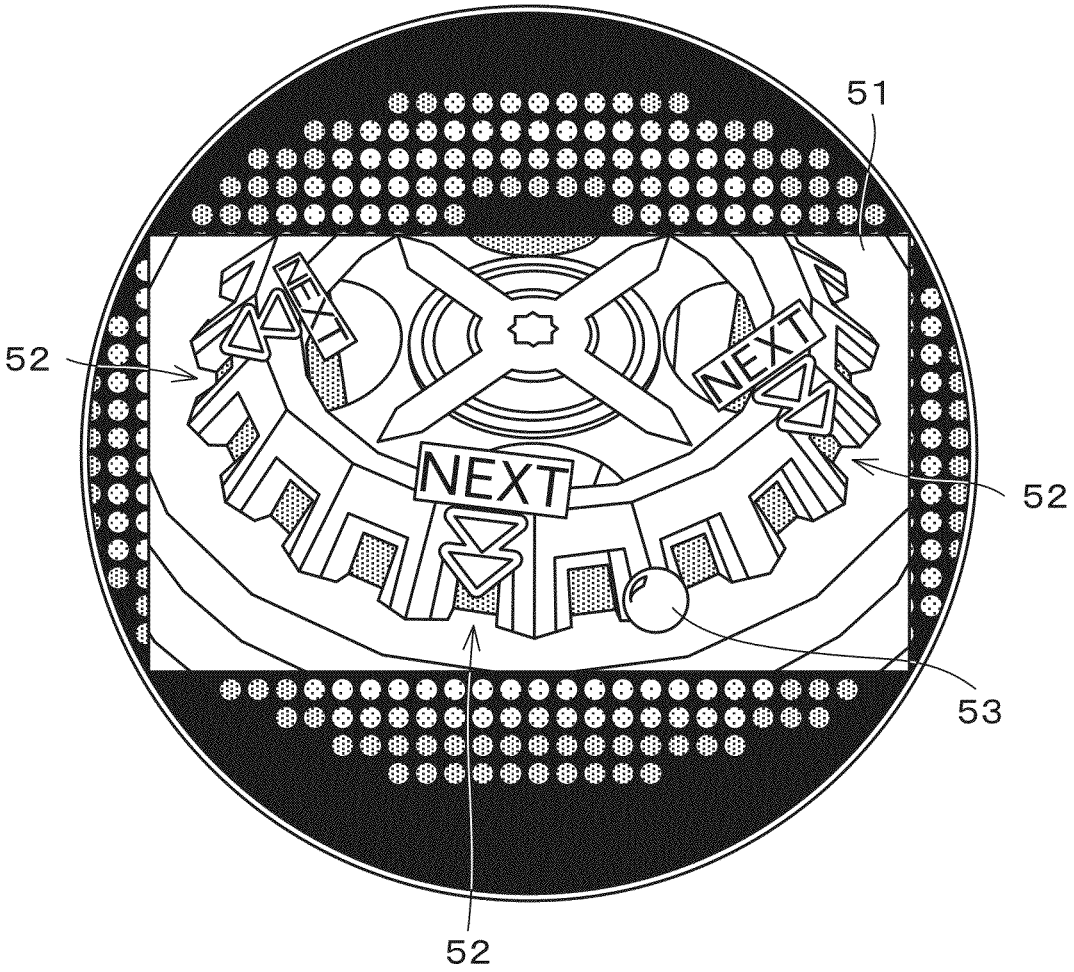
FIG. 6 is a diagram illustrating an example of a lottery machine displayed in the common display device.

FIG. 6 is a view illustrating an example of the lottery machine displayed in the common display device 4. A lottery machine 51 includes a dune-type lottery mechanism. When a lottery ball 53 enters a predetermined lottery hole 52, the lottery is won. In the chance game, a variety of lottery machines such as a pachinko-type lottery machine and a pinball-type lottery machine are prepared, and any one lottery machine among the prepared lottery machines, for example, the lottery machine 51 is used to execute the lottery. When the lottery is won, a lottery can be executed by the next lottery machine. When the lottery is not won, the chance game is ended, a medal payment is performed according to the lottery result and the game returns to a normal game. In the chance game, when winning three lotteries in the lottery machines, the player can obtain more jackpots. As for the winning probability of three lottery machines preformed in the chance game, the winning probability of the first lottery machine is set to 1/2, the winning probability of the next lottery machine is set to 1/4 and the winning probability of the last lottery machine is set to 1/5. When winning the respective lottery machines, the player can receive a payment of 100 pieces of medals in the first lottery machine, can receive a payment of 300 pieces of medals in the next lottery machine and can receive a payment of 500 pieces of medals in the last lottery machine. As for the jackpot, pieces of medals accumulated in jackpot winning are paid to the player.

Figure 7:
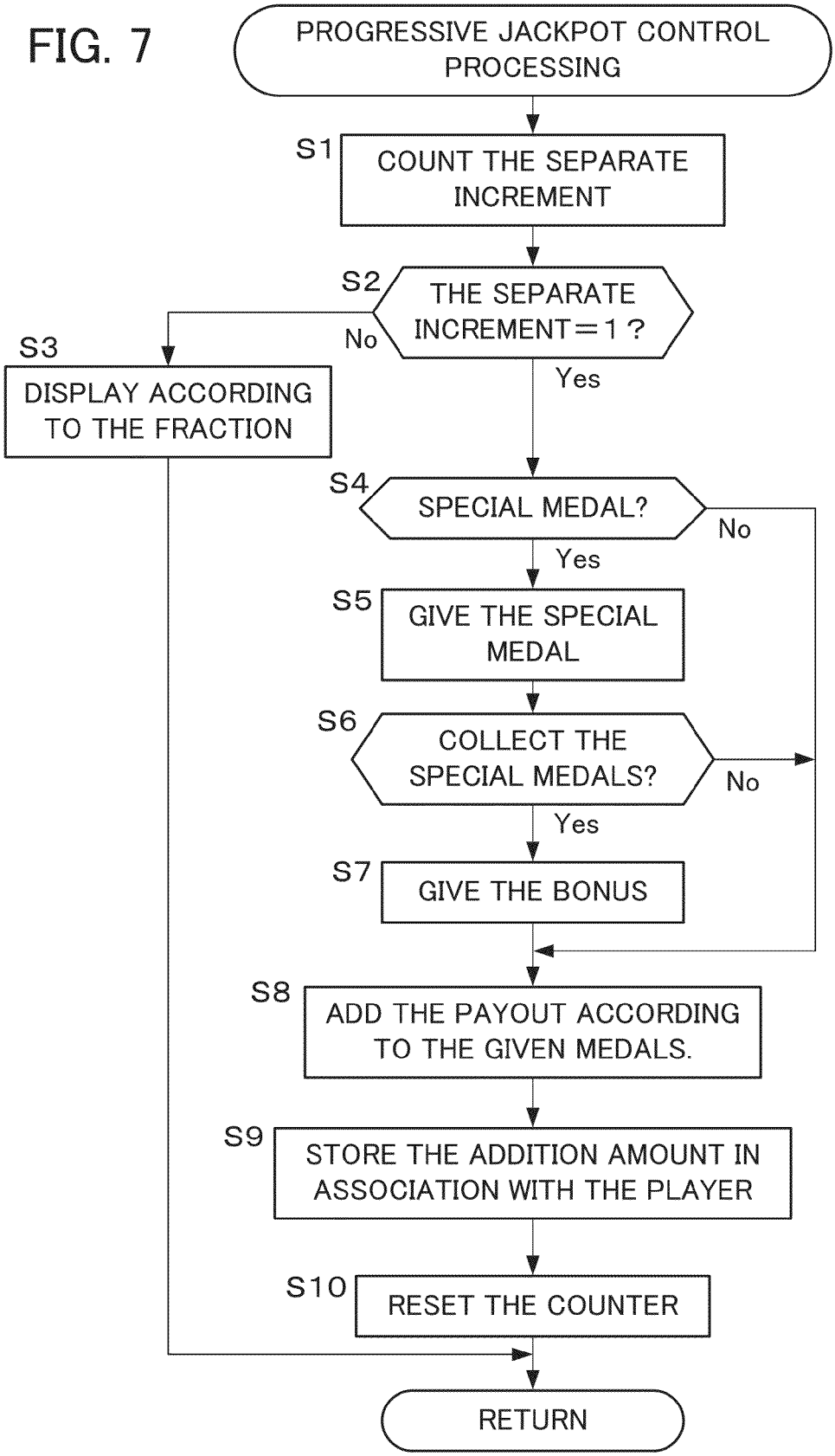
FIG. 7 is a flow chart illustrating a progressive jackpot control processing routine executed by a control unit.

FIG. 7 is a flow chart illustrating a progressive jackpot control processing routine executed by the control unit 40. The game machine 1 adopts an accumulation-type progressive jackpot system in which the jackpot is set and payout of the jackpot is accumulated according to the number of pieces of medals input into the game machine 1. The payout medals of the jackpot are accumulated according to the number of pieces of medals input into the game machine 1 by the player and are stored in the storage device 41 of the game machine 1. The payout increment of the jackpot is stored as the separate increment in each play data 45 of each player. As an example, 1% of the number of pieces of medals inserted by the player is stored as a separate increment of the player. When the player inputs one piece of medal into the game machine 1, the separate increment increases by 0.01 piece.

Figure 8A:
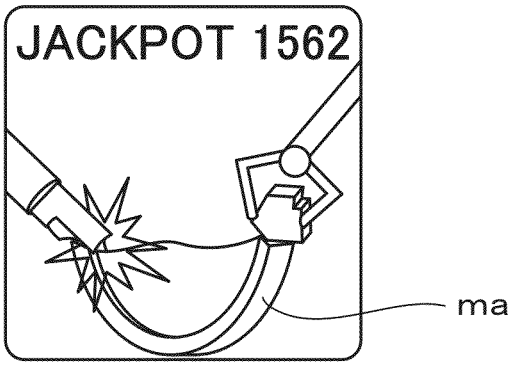
FIG. 8A is a diagram illustrating an example of a fraction of a separate increment displayed on the game screen.
Figure 8B:
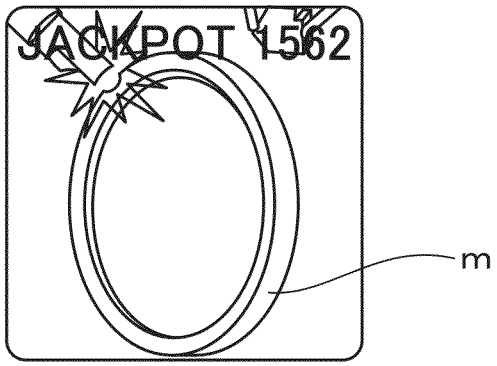
FIG. 8B is a diagram subsequent to FIG. 8A.
Figure 8C:
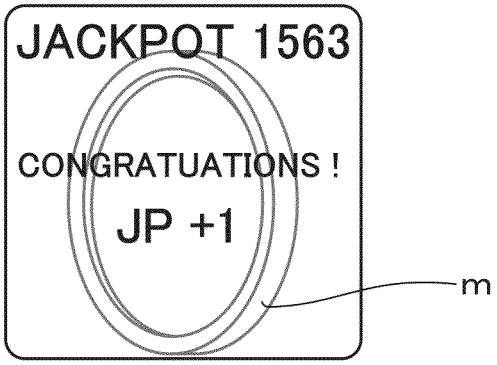
FIG. 8C is a diagram subsequent to FIG. 8B.

First, the control unit 40 counts the separate increment for each player (step S1). Since the separate increment increases according to the number of pieces of input medals, the number of pieces of input medal may be counted with respect to each player. The control unit 40 stores the separate increment counted for each player in the play data 45 of each player. The control unit 40 determines whether the separate increment has reached one piece (step S2). When the separate increment is a fraction smaller than 1, the control unit 40 executes processing according to the fraction (step S3). FIGS. 8A to 8C are diagrams illustrating an example of the fraction of the separate increment displayed on the game screen. FIGS. 8A to 8C represent the separate increment by an animation of generating a JP medal m. The example of FIG. 8A represents the state of the separate increment being about 0.40 piece and displays a generated medal ma as a target object with a portion of the JP medal m represented. The monitor 13 displays the animation in which the generated medal ma is completed gradually whenever the player inputs medals. The payout of the jackpot may be displayed together with the generated medal ma. Furthermore, a game screen GS and a medal generation screen may be switched based on an operation of the player. When the separate increment increased in the operation is presented to the player, the control unit 40 quits the processing.

Figure 9A:
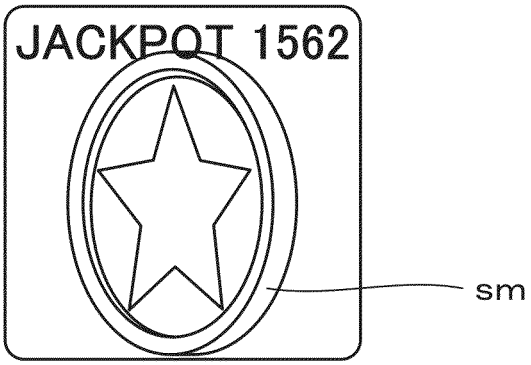
FIG. 9A is a diagram illustrating an example of a special medal.
Figure 9B:
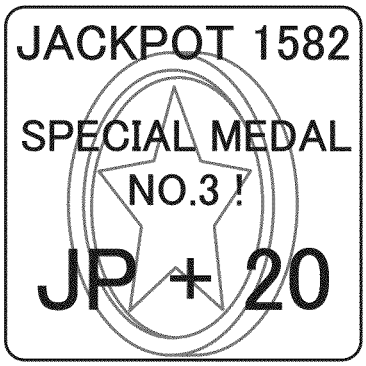
FIG. 9B is a diagram subsequent to FIG. 9A.

On the other hand, when step S2 determines that the separate increment has formed one piece, the control unit 40 determines whether the JP medal m is a special medal sm (step S4). FIG. 8B is a diagram subsequent to FIG. 8A. FIG. 8B illustrates completion of the JP medal m. When the JP medal m is completed, as illustrated in FIG. 8C, the completion of the JP medal m is displayed and an increment of 1 of a jackpot payout is represented. The JP medal m of FIG. 8C is a normal JP medal m, not a special medal sm. On the other hand, in generation of the JP medal m of FIG. 8B, the special medal sm is generated with a predetermined probability. In FIGS. 9A and 9B, an example of the special medal sm is shown. For example, when the special medal sm is generated, an animation with the JP medal m inverted is displayed after generation of the JP medal m of FIG. 8B and the special medal sm having a pattern attached thereto is displayed as illustrated in FIG. 9A. A random pattern is attached to the special medal sm such that the special medal sm can discriminated from the normal JP medal m. Furthermore, a plurality of types of special medals sm is provided, and is different according to the types.

Figure 10:
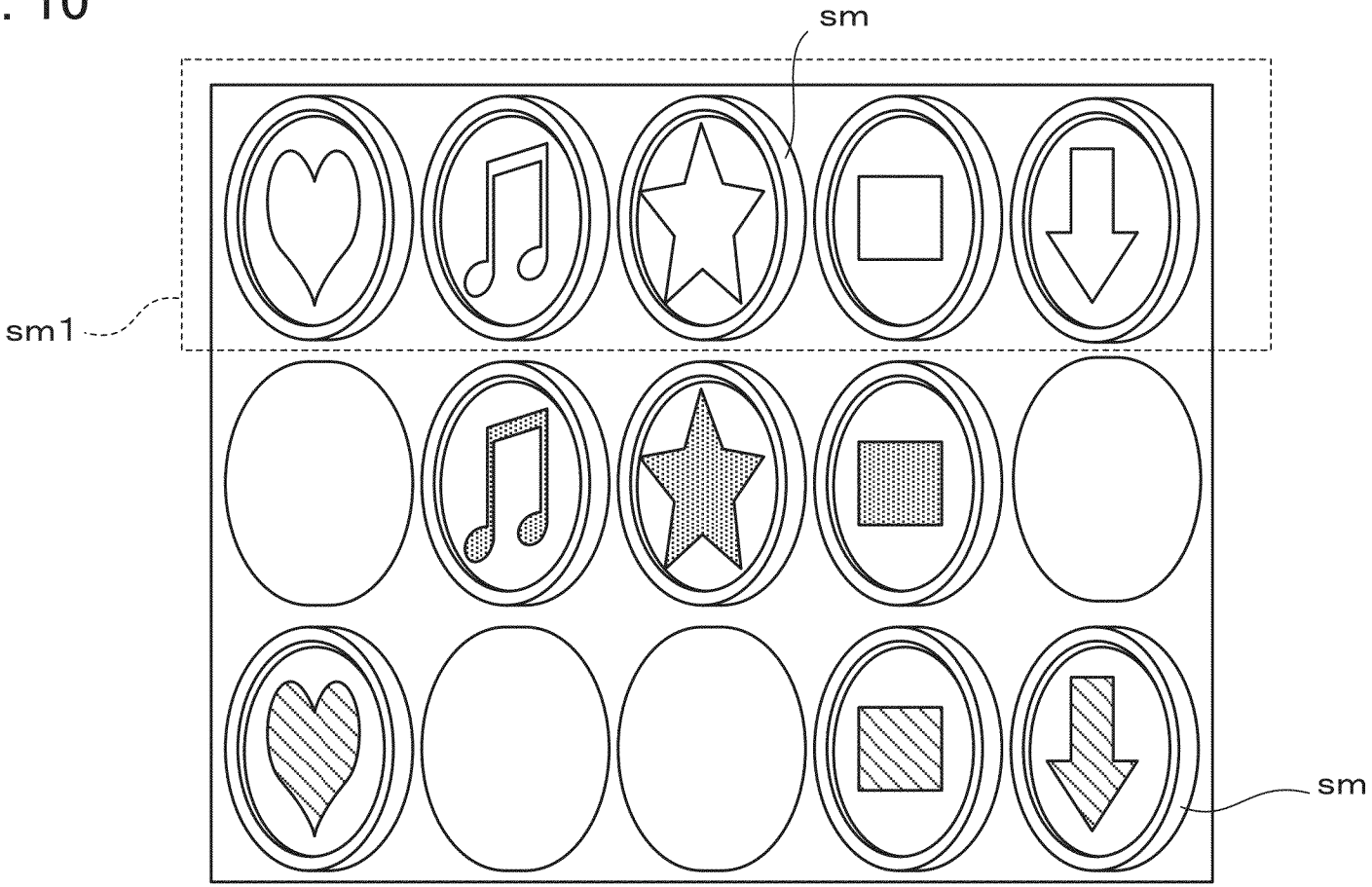
FIG. 10 is a diagram illustrating an example of a collection screen of special medals.

When the control unit 40 determines that the special medal sm has been generated, the control unit 40 gives the special medal sm to the player (step S5). FIG. 9B illustrates a display notifying the giving of the special medal sm to the player. In the example of FIG. 9B, while the jackpot generally increases by one piece, the jackpot increases by 20 pieces (20 times) by generation of the special meal sm. An appropriate multiple such as 5 times or 50 times is set according to the type of the special medal sm. Furthermore, the special medal sm given to the player can be collected as a collection item by the player. FIG. 10 is a diagram illustrating an example of a collection screen CS of the special medals sm. The collection screen CS displays the special medal sm that is already obtained by the player, among the special medals sm that can be collected by the player. On the other hand, the special medal sm that is not yet obtained by the player is represented as a blank. By displaying the collection screen CS on the monitor 13, the player can identify the type of the collected special medal sm. The collected special medal sm is stored in the play data 45 of each player.

The control unit 40 determines whether the player has collected a predetermined type of special medal sm (step S6). For example, when a group of the special medals sm1 displayed on the collection screen CS illustrated in FIG. 10 has all been collected, the control unit 40 increases JP medals m, which are added to the jackpot payout as a bonus, by a predetermined number of pieces (step S7). The special medals sm to be collected are set appropriately according to games. Furthermore, the number of JP medals m given as a bonus may be changed appropriately. The control unit 40 makes an addition to the jackpot payout according to the given JP medals m (step S8). When the JP medal m is not the special medal sm in step S4, one piece of JP medal m is added to the jackpot. When the JP medal m is the special medal sm in step S4, piece of JP medals m marked in the special medal sm are added to the jackpot. When the group of the special medals sm1 has all been collected, an additional JP medal m is added as a bonus.

Figure 11:
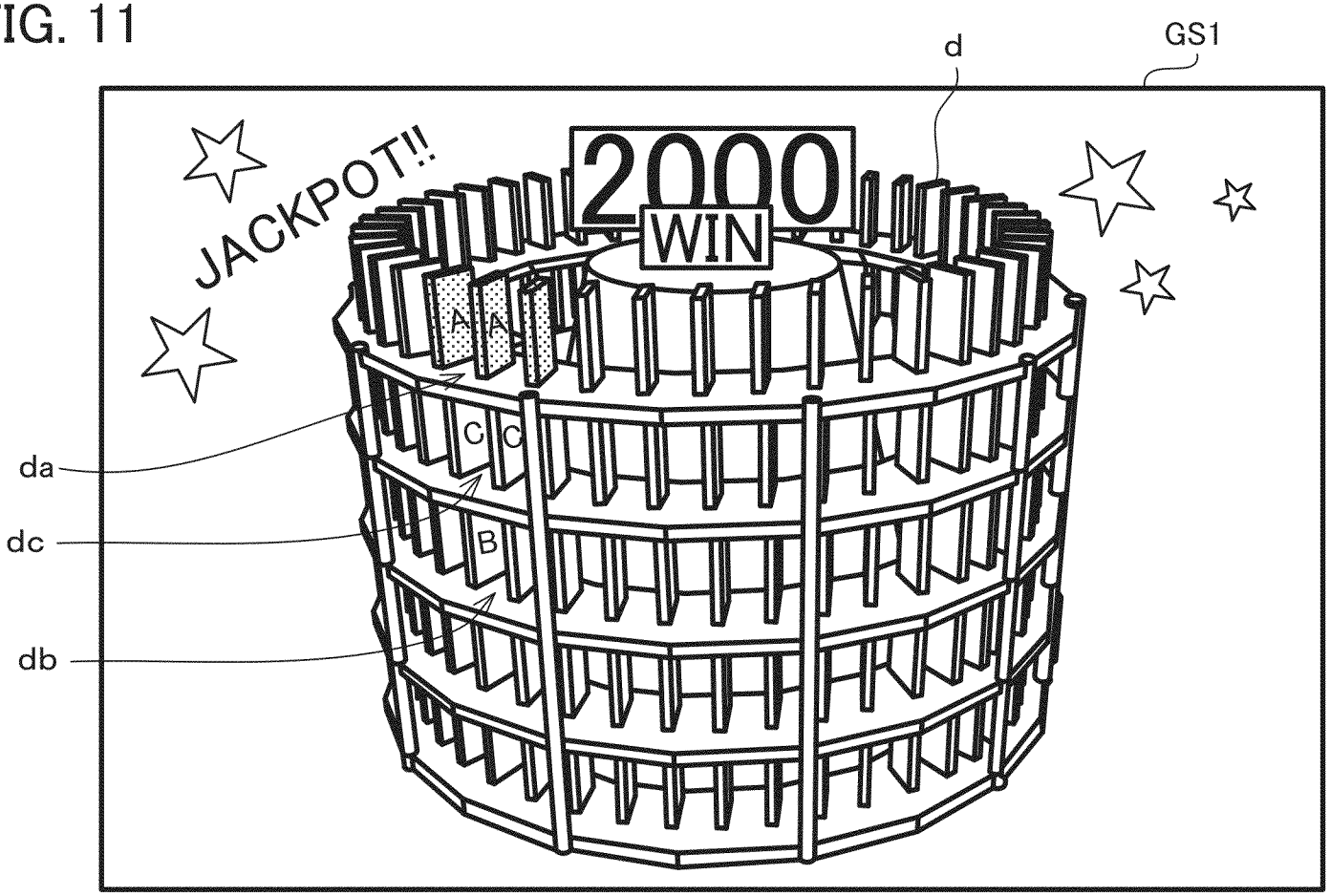
FIG. 11 is a diagram illustrating the accumulation of jackpots displayed on a game screen.

The control unit 40 stores the number of pieces of JP medals m, which are obtained by the player and added to the jackpot payout, in association with the player (step S9). The number of pieces of JP medals m added is stored in the play data 45 of the player. Furthermore, an indication representing the addition by the player (for example, a player name, a mark, or color coding) may be attached to the accumulated jackpot payout displayed on the game screen. FIG. 11 is a diagram illustrating the accumulation of jackpots displayed on a game screen GS1. The game screen GS1 is displayed on the liquid crystal display 22 of the common display device 4. The game screen GS1 may be displayed on the monitor 13 of each station unit 2. In the example of FIG. 11, dominoes d are repeatedly stacked as the jackpot payout. One piece of domino d is stacked in exchange for the JP medal m. A player name A is displayed with respect to the domino da stacked by the player. The control unit 40 resets the counter of the separate increment (step S10), and quits the processing.

According to the above-described processing, the separate increment of each player playing in the game machine 1 is counted (step S1). When the separate increment is the fraction less than the generation of the JP medal m, the JP medal m being generated according to the fraction owned by the player is displayed (step S3). The concept of the progressive jackpot is visually displayed and the animation generating the JP medal m is displayed according to a player's action of inserting the medal into the game machine 1. Therefore, it is easy to know the relation between the player's action and the increasing jackpot payout. Furthermore, when the separate increment forms one piece, the number of medals added to the jackpot changes according to the acquisition of the special medal sm or the normal JP medal m (steps S4 to S8). When a predetermined special medal sm is collected, an additional bonus is given, thus making it possible to give the player the pleasure of collecting special medals sm.

In the above-described processing, the jackpot control portion 43 of the control unit 40 serves as a fraction managing device by executing the processing of step S1, serves as a fraction display control device by executing the processing of step S3, serves as a collection item giving device by executing the processing of step S5 and serves as a payout adding device by executing the processing of step S8. Furthermore, the monitor 13 or the common display device 4 serves as a display device and the storage device 41 serves as an addition amount storage device.

Figure 12:
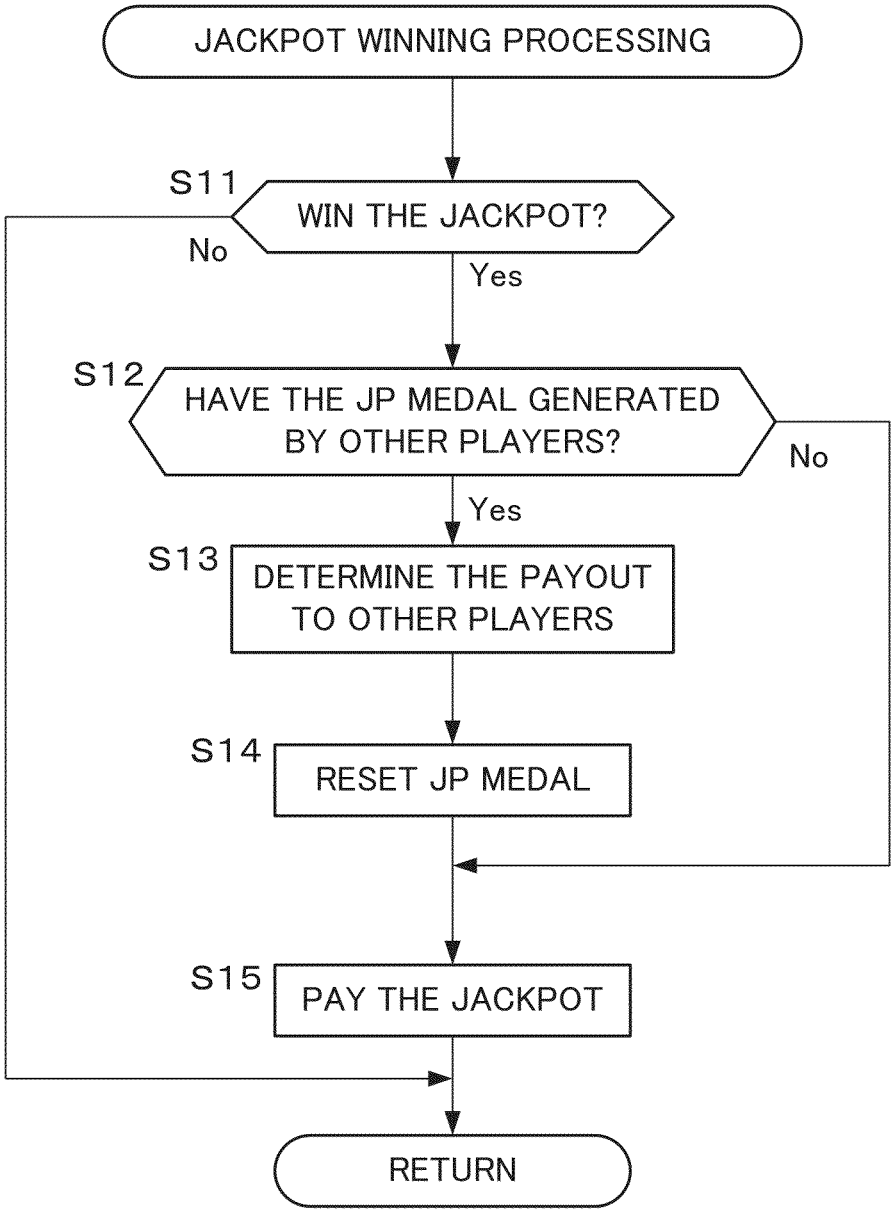
FIG. 12 is a flow chart illustrating a jackpot winning processing routine executed by the control unit.

FIG. 12 is a flow chart illustrating a jackpot winning processing routine executed by the control unit 40. The jackpot winning processing routine is processing performed when the jackpot is paid in the game machine 1. As described above, the jackpot in the game machine 1 can be obtained by winning a chance game. First, the control unit 40 determines whether the jackpot is won (step S11). When any player playing in the game machine 1 wins the jackpot, the control unit 40 determines whether there is the JP medal m generated by other players (step S12). As illustrated in FIG. 11, when other players than the player winning the jackpot generates the JP medals m and stacks dominoes db and dc, the control unit 40 pays payout to other players from the entire jackpot according to the number of pieces of stacked dominoes db and dc (the number of pieces of obtained JP medals m) (step S13). The payout paid to other players is dependent on the number of pieces of stacked dominoes db and dc. The control unit 40 resets the number of pieces of JP medals m stored in the play data 45 (step S14). The control unit 40 pays all of the remaining jackpot to the winning player (step S15) and quits the processing.

According to the above-described processing, when the jackpot is won (step S11), the payout is also paid to other players contributing to the accumulation of the jackpot (step S13), and then the jackpot payout is paid to the jackpot winner (step S14). When the jackpot is paid in the game machine 1, even the player not to play the chance game can receive payout corresponding to the contribution to the accumulation of the jackpot. Therefore, a sense of unity is generated between the players playing in the game machine 1, which makes the atmosphere of the game more enjoyable. Incidentally, the jackpot control device 43 of the control unit 40 serves as a payment executing device by executing the processings of steps S13 and S14.

The present invention is not limited to the above-described aspect, and can be carried out in various kinds of aspects. For example, in the above-described aspect, the game machine 1 has been described as a stand-alone type, but the present invention is not limited thereto. For example, a plurality of game machines 1 and a server device may be communicatively connected through a network to constitute a game system. A progressive jackpot may be set to be shared in the plurality of game machines 1, and the payout of the progressive jackpot or the play data 45 of each player may be stored in a storage device of the server device. Furthermore, the jackpot has been described as being accumulated according to the insertion of the medal by the player, but the present invention is not limited thereto. For example, the jackpot may be accumulated whenever a predetermined game condition is satisfied. As an example of the game condition, the collapse of an enemy character EC may be set, and the separate increment may be set to increase by 0.05 piece whenever the enemy character EC is collapsed. The separate increment may be set appropriately according to games.

In the present aspect, the JP medal m has been described as being generated as the fraction of the separate increment, but the present invention is not limited thereto. For example, although a domino has been used as an image representing the accumulation of the jackpot, an animation representing the generation of the domino may be displayed. In addition, instead of the JP medal m, a suitable representation such as a ball, a toy block, a candy or a doll may be used to represent the fraction. Furthermore, the fraction may be represented by numerals.

What is claimed is:

1. A game machine which adopts an accumulation-type progressive jackpot with a jackpot payout increasing according to a game play of a player of a plurality of players and increases the jackpot payout by a predetermined unit according to a predetermined number of game plays by the player, wherein the game machine comprising:

a plurality of station units, each of the station units including a display device which displays a game screen and a game media accepting device for accepting physical game media to initiate game play;

a storage device; and, a control unit coupled to the display device and to the storage device for receiving data indicative of a game play of a player at a corresponding station unit, the control unit including:

a fraction managing device which counts the jackpot payout increasing according to the game play of the player wherein the jackpot payout increasing is counted as a separate increment of each player of the plurality of players, stores the jackpot payout increasing in the storage device, and manages a fraction with the separate increment smaller than the predetermined unit in association with the player; and a fraction display control device which controls the display device so as to display the fraction.

2. The game machine of claim 1, wherein the fraction display control device makes the display device display a portion of a target object for counting the jackpot payout according to a ratio of the fraction.

3. The game machine of claim 2, wherein the target object is a medal.

4. The game machine of claim 1, further comprising, a payout adding device which adds a predetermined unit to the jackpot payout in case that the separate increment satisfies the predetermined unit in the fraction managing device.

5. The game machine of claim 1, further comprising, a payout adding device which adds a predetermined multiple of a predetermined unit to the jackpot payout in case that the separate increment satisfies the predetermined unit in the fraction managing device.

6. The game machine of claim 4, comprising, an addition amount storage device which stores an amount of predetermined units added by the player in association with the corresponding player in case that the jackpot payout is added by the payout adding device.

7. The game machine of claim 6, comprising, a payment executing device which executes a payment of the jackpot payout, wherein the payment executing device pays a portion of the jackpot payout to other players according to the amount added to the jackpot payout by the other players in case that the jackpot payout is paid to the player wining the accumulation-type progressive jackpot.

8. The game machine of claim 1, further comprising, a collection item giving device which gives at least one item among a plurality of types of collectable items in case that the separate increment satisfies the predetermined unit.

9. The game machine of claim 8, wherein the payout adding device adds a predetermined amount to the jackpot payout in case that a predetermined type of item is collected among the plurality of types of collectable items.

10. The game machine of claim 1, the display device including a central display and a rotary driving mechanism for rotating the central display.

11. A game control method executed in a game machine which adopts an accumulation-type progressive jackpot with a jackpot payout increasing according to a game play of a player of a plurality of players and increases the jackpot payout by a predetermined unit according to a predetermined number of game plays by the player, the game machine including a plurality of station units, a control unit, and a storage device coupled to the control unit, each of the station units including a game media accepting device for accepting physical game media to initiate game play and a display device wherein the game control method comprising:

receiving, by the control unit from the plurality of station units, data indicative of game play of a player at a corresponding station unit and storing the game play data in a storage device;

a fraction managing step which counts, by the control unit, the jackpot payout increasing according to the game play of the player wherein the jackpot payout increasing is counted as a separate increment of each player of the plurality of players, stores the jackpot payout increasing in the storage device, and manages a fraction with the separate increment smaller than the predetermined unit in association with the player; and a fraction display control step which controls the display device of the station unit played by a player associated with the fraction so as to display the fraction.

12. The game control method of claim 11, the display device including a central display and a rotary driving mechanism for rotating the central display.

13. A game machine which adopts an accumulation-type progressive jackpot with a jackpot payout increasing according to a game play of a player of a plurality of players and increases the jackpot payout by a predetermined unit according to a predetermined number of game plays by the player, wherein the game machine comprising:

a display device which displays a game screen;

a station unit, the station unit including a coin insertion slot for receiving coins from the player for use with game play; and, a control unit coupled to the display device and the station unit, the control unit configured to receive data indicative of a game play of a player at the station unit, the control unit including:

a storage device;

a fraction managing device which counts the jackpot payout increasing according to the game play of the player wherein the jackpot payout increasing is counted as a separate increment of each player of the plurality of players, stores the jackpot payout increasing in the storage device, and manages a fraction with the separate increment smaller than the predetermined unit in association with the player; and a fraction display control device which controls the display device so as to display the fraction.

14. The game machine of claim 13, the display device including a central display and a rotary driving mechanism for rotating the central display.

15. A game control method executed in a game machine which adopts an accumulation-type progressive jackpot with a jackpot payout increasing according to a game play of a player of a plurality of players and increases the jackpot payout by a predetermined unit according to a predetermined number of game plays by the player, the game machine including a control unit, a storage device coupled to the control unit, and a station unit coupled to the control unit, the control unit configured to receive data indicative of a game play of a player at the station unit, the station unit including a coin insertion slot for receiving coins from the player for use with game play, the game method including:

receiving, via a game media acceptance device, a coin from the player and responsively initiation game play;

a fraction managing step which counts, by the control unit, the jackpot payout increasing according to the game play of the player wherein the jackpot payout increasing is counted as a separate increment of each player of the plurality of players, stores the jackpot payout increasing in the storage device, and manages a fraction with the separate increment smaller than the predetermined unit in association with the player; and a fraction display control step which controls a display device which displays a game screen so as to display the fraction.

16. The game control method of claim 15, the display device including a central display and a rotary driving mechanism for rotating the central display.

* * * * *